US005165969A

United States Patent [19]

Barlett et al.

[11] Patent Number: 5,165,969

[45] Date of Patent: Nov. 24, 1992

[54] RECIRCULATING PAINT BOOTH AND THERMAL OXIDIZER

[75] Inventors: Jack D. Barlett, Fairborn; Robert D. Grear, Springfield; Ronald C. Read, Dayton, all of Ohio; William E. Harrison, Royal Oak; James R. Hutchens, Farmington Hills, both of Mich.

[73] Assignee: Navistar International Transportation Corp., Chicago, Ill.

[21] Appl. No.: 763,797

[22] Filed: Sep. 23, 1991

Related U.S. Application Data

[63] Continuation of Ser. No. 303,353, Jan. 27, 1989, abandoned.

[51] Int. Cl.[5] ..... B05B 15/04; B05D 1/02

[52] U.S. Cl. ..... 427/421; 118/663; 118/326; 118/DIG. 7; 55/DIG. 46

[58] Field of Search ..... 118/663, 326, DIG. 7; 427/421; 55/DIG. 46

[56] References Cited

U.S. PATENT DOCUMENTS

| | | | |
|---|---|---|---|
| 3,881,874 | 5/1975 | Shular et al. | 423/210 |
| 4,266,504 | 5/1981 | Roesner | 427/421 |
| 4,574,005 | 3/1986 | Cobbs, Jr. et al. | 55/89 |
| 4,616,594 | 10/1986 | Itho | 118/DIG. 7 |
| 4,630,567 | 12/1986 | Bambousek et al. | 118/326 |
| 4,714,044 | 12/1987 | Kikuchi et al. | 118/326 |
| 4,758,642 | 7/1988 | Yezrielev et al. | 526/213 |
| 5,066,522 | 11/1991 | Cole et al. | 427/422 |

*Primary Examiner*—Shrive Beck
*Assistant Examiner*—Katherine A. Bareford
*Attorney, Agent, or Firm*—Dennis K. Sullivan

[57] ABSTRACT

A paint booth facility for painting truck cabs and attachments in which electronic robots operating electrostatic paint guns apply successive coats of paint. The object to be painted is indexed through a series of spray booths, flash-off booths and finally curing ovens all of which have a contained atmosphere. The level of volatile organic compounds (VOC) in the paint booth atmosphere is not permitted to exceed 25% of its lower explosive limit but is maintained at a level that is higher than permitted in paint booths that are occupied by humans. A portion of the recirculated paint booth atmosphere is directed to a thermal oxidizer where it is ignited autogeneously, and this portion is replaced by fresh air that has been conditioned.

34 Claims, 4 Drawing Sheets

16800 SCFM
40
56000 SCFM
32
136
3600 SCFM
61600 SCFM
31
4000 SCFM
4000 SCFM
22
2000 SCFM
16800 SCFM
302
5600 SCFM
61600 SCFM
56000 SCFM
4000 SCFM
2000 SCFM
52000 SCFM
13
12
21
336
2000 SCFM
202
3600 SCFM
56000 SCFM
236
4000 SCFM
2000 SCFM
5600 SCFM
136
50
19
18
11
10
100
101
119
102
56000 SCFM
33600 SCFM
61600 SCFM
136
4000 SCFM
3
5600 SCFM
5600 SCFM
136
4000 SCFM
54000 SCFM
80
57

RECIRCULATING PAINT BOOTH AND THERMAL OXIDIZER

This is a continuation of application Ser. No. 07/303,353, filed Jan. 27, 1989.

BACKGROUND OF THE INVENTION

This invention relates to a paint facility. For example, a paint facility for painting truck cabs, parts, and accessories.

Four major criteria were considered in developing this paint facility (1) quality of the painted surface, (2) air pollution control, (3) energy conservation, and (4) paint transfer efficiency. The stated order of these four criteria does not reflect their priority or importance. However, the need to meet emissions limitations was the primary consideration and satisfying this need in an energy-efficient system was a synergistic result. Reference is hereby made to an article entitled, "Designing Conservation into Air Pollution Control Systems" by W. E. Harrison. The subject matter of this article is incorporated herein by reference and made a part hereof A clean environment is necessary in a paint booth to obtain a high-quality finish It is conventional to filter the air coming into a paint booth and for workers within the booth to wear overclothes made of non-fiber-shedding clothing. It is also conventional to clean the objects to be painted prior to bringing them into the paint booth, and to take steps to insure that the compressed air and the paint are not contaminated. Despite these precautions, paint flaws have not been decreased to an acceptable level. Correction of flawed surfaces is possible; however, it is a time-consuming and expensive process. Furthermore, sanding down flaws produces dust which must be eliminated prior to repainting or the problem will be compounded It has been established by careful examination of paint flaws that the dust and fibrous particles that have caused flaws of a size visible to the naked eye have not passed through the filter, or broken off from the fibrous material of the filter used to clean the incoming air. The more likely source for such dust and fibrous particles is that they were carried into the paint booth by paint booth personnel or entered through the access area through which the workers enter and leave the paint booth.. Reference is hereby made to an article by Mr. Carl Frudenberg entitled, "Dust-Free Painting". The subject matter of this article is incorporated herein by reference and made a part hereof. By utilizing computer-controlled robots to apply the paint, people carrying dust on their clothing have been eliminated from the spray booths which was a significant source of flaw causing material. Probably the most significant aspect of this phenomenon is the virtual elimination of the need to open the paint booth to the external environment to permit the entrance and egression of the paint booth workers The transfer efficiency of a spray painting device is the percent of paint leaving the nozzle that is transferred to the object to be painted. As the transfer efficiency is increased the amount of wasted paint decreases and there is a corresponding decrease in the volatile organic compounds (VOC's) deposited into the spray booth atmosphere. If 100% transfer efficiency is attained the VOC's deposited into the spray booth atmosphere will be minimized. Electronic robot and electrostatic spray guns greatly increase transfer efficiency by creating an electrical attraction between the paint and the object to be painted. When electrostatic spraying, electrically charged paint droplets move along lines of force which exist between the electrically charged spray gun and the grounded part to be painted. Reference may be had to U.S. Pat. No. 4,679,734 for a disclosure of an electrostatic spray gun. The subject matter of this patent is incorporated herein by reference.

The utilization of robots to apply paint further improves the transfer efficiency of a painting process. Optimal paint patterns for the robot, that minimize paint missing the product to be painted and applying thicker coats then desired, can be developed and repeated for each product.

Since this is a continuous painting process both the entrance and the exit to the paint booth must be open to permit the articles to be painted into and out of the paint booth. The atmosphere in the spray booths includes a level of volatile organic compounds (VOC) that for health, safety and environmental reasons cannot be permitted to escape into the room that houses the paint booth. This is accomplished by introducing air under pressure, directed toward the first spray booth, into the tack off area of the paint booth and removing an equal amount of air from the prime repair booth. The air flow through each spray booth is downwardly pulling with it some atmosphere from the adjacent flash off tunnels. Air is also introduced into the exit end of the third flash off tunnel and is directed back toward the third spray booth. In this way the high concentration of VOC's flowing downwardly through the spray booths is sealed within the paint booth by the air flow toward the first and third spray booths.

Another type of paint flaw is called "sag". This flaw is caused if the newly applied paint flows or sags, forming a build-up or thickened area of paint. Sagging occurs if the paint solvents do not evaporate or "flashoff" fast enough, thus permitting the wet paint to flow or sag. The occurrence of this flaw is influenced by the percent saturation of solvent in the paint booth atmosphere. When the percent saturation of solvent in the atmosphere is high, the rate of evaporation or flash-off of the solvent of newly applied paint is slowed and the newly applied paint will flow or sag. Thus, it is important to control the percent saturation of solvent in the paint booth atmosphere, maintaining it at levels that will not adversely affect the flash-off rate of newly applied paint. It has been found that the solvent concentration of one solvent in the paint booth atmosphere does not affect the evaporation or flash-off of a second different solvent. Thus, by constructing the paint to include a plurality of solvents, the solvent concentration of each of the several solvents can be maintained at low levels. It has been found that percent saturation of a solvent begins to hinder solvent evaporation time before reaching significant lower explosive limit risk levels for volatile organic compounds. Utilizing a paint having at least three different solvents, none of which comprise more than 50 percent of the total solvents, has been found to be a solution to the sag flaw problem. It has been found that an upper limit of fifteen (15) percent saturation for any one solvent provides a limit for paint quantity environment. The use of high vapor pressure solvents such as Methyl Ethyl Ketone results in quick flashoff as compared to solvents, such as Methyl Amyl Ketone, having low vapor pressures and corresponding relatively slow flashoff. Also it is well known in the paint industry to use sag control agents in mixing paints.

When a liquid evaporates into a limited space, two opposing processes are in operation. The process of vaporization tending to change the liquid to the gaseous state and the process of condensation which tends to change the gases back into the liquid state. The rate of condensation is increased as vaporization proceeds and the pressure of this vapor increases. If sufficient liquid is present, the pressure of the vapor ultimately reaches a value at which the rate of condensation equals the rate of vaporization. When this condition is reached, a dynamic equilibrium is established and the pressure of the vapor will remain unchanged. The pressure exerted by the vapor at such equilibrium conditions is termed the vapor pressure of the liquid. The vapor pressure of a liquid is determined by its intermolecular attractive forces. Thus, if a substance has relatively low intermolecular attractive forces, the rate of loss of molecules from its surface is large and the corresponding equilibrium vapor pressure is high. Solvents such as Xylene, Butanol, Methyl Amyl Ketone, P.M. Acetate, Ektasolve EEP and Butyl Cellosolve Acetate have relatively high intermolecular attractive forces, their rate of vaporization is low, and their vapor pressure is low.

The following table provides the Evaporation Rates and Vapor Pressures of a number of common solvents. Solvents having a Relative Evaporation Rate greater than 1.0 are classified as High Vapor Pressure Solvents while those having a Relative Evaporation Rate less than 1.0 are classified as low vapor pressure solvents. It should be noted that there is a general direct relationship between Relative Evaporation Rate and Vapor Pressure, i.e. a solvent having a high Relative Evaporation Rate has a high Vapor Pressure. However, there are some exceptions to this generalization. For example, Butyl Acetate—Xylene and Methyl Amyl Ketone—P.M. Acetate. Although the quick flashoff of high vapor pressure solvents is desirable, such solvents tend to exceed our upper limit of 15% saturation. As a result solvents classified as low vapor pressure solvents are used in formulating paint for use in this process.

| | Relative Evaporation Rate (Butyl Acetate = 1.0) | Vapor Pressure (Millimeters of Mercury at 20° C.) |
|---|---|---|
| Ethyl Acetate | 6.2 | 76 |
| Methyl Ethyl Ketone | 5.7 | 70 |
| Isopropanol | 1.7 | 31 |
| Toluene | 1.5 | 38 |
| Isobutyl Acetate | 1.45 | 13 |
| Butyl Acetate | 1.0 | 8 |
| Xylene | 0.75 | 9.5 |
| Butanol | 0.45 | 4 |
| Methyl Amyl Ketone | 0.4 | 2.1 |
| P.M. Acetate | 0.34 | 3.8 |
| Ektasolve EEP | 0.12 | 1.5* |
| Butyl Cellosolve Acetate | 0.03 | 0.29 |

*25° C.

If a paint booth is 100 percent or nearly so vented to the atmosphere, and the exhausted atmosphere is replenished by fresh air, the volatile organic compounds (VOC) released to the atmosphere are uncontrolled and likely to be unacceptable, depending upon their concentrations in the paint as applied and could be considered a violation of current Environmental Protection Agency (EPA) regulations. In a conventional paint booth employing human workers, the VOC level must, to comply with OSHA rules, be maintained at a relatively low level. In order to meet EPA regulations the VOC's must be removed or reduced considerably from the paint line atmosphere prior to releasing it to the outside atmosphere. Such spray booth exhaust is a major source of VOC emissions from a paint system since 90 percent of the total VOC's is volatized in the spray booth and flash-off areas.

The atmosphere within the paint booth also becomes contaminated with paint particulate. A scrubber located at the bottom of the paint booth is designed to reduce to 1½ to 2 grains of paint particulate per 1000 standard cubic feet per minute of exhaust air. The scrubber consists of a pair of flood sheets extending the length of the paint booth. The lower longitudinal edges of the flood sheets are spaced from each other and form a venturi. Water-including detackification chemicals flow down the flood plates and through the venturi. This low energy venturi creates 6" to 6.5" water static pressure drop. The spray booth atmosphere also flows through this venturi and is exposed to the low pressure causing the paint particles to drop out of the atmosphere. Below the venturi the paint particulate is collected in a water collecting sump formed in the bottom of the paint booth, and the atmosphere flows through a mist eliminator to the discharge duct. Paint sludge forms and floats on the surface of this water. Very low levels of solvent are found in the water and sludge (2–3% in the water and 1% in the sludge). The moisture concentration of the atmosphere flowing out the discharge duct is near saturation (95 to 100 percent relative humidity).

In a spray booth in which there are no human workers a much higher level of VOC can be tolerated. By monitoring the VOC levels and insuring the levels do not exceed 25 percent of the lower explosive level (LEL) a higher then typically experienced yet safe environment has been attained. By increasing the VOC levels of concentration it is possible to optimize the performance of a thermal oxidizer system in which the VOC's are oxidized, and thus, not released to the outside atmosphere. The heat generated from oxidation of the VOC's is used to heat the paint booth exhaust atmosphere to a temperature at which little or no extra fuel is needed in the oxidation process. The thermal oxidizer operating cost will be reduced significantly if the solvent concentration in the paint booth exhaust is high enough to support combustion without auxiliary fuel. Theoretically, operating at 3 percent of the LEL will result in autogenous combustion. The exhaust from the thermal oxidizer is relatively clean and can be released to the outside atmosphere.

The recirculated atmosphere, as well as the make-up air, is filtered and conditioned before it is directed into the top of the paint booth. Proper operation of the paint booth requires a constant booth environment in the range of 65–80° F. and 55–85% relative humidity. Precise control of the spray booth temperature and relative humidity greatly enhances the quality of the painted product since it provides a constant year-round standard painting environment thus eliminating the need to adjust the paint formulations to compensate for seasonal weather variations as is required in conventional paint line applications. Filtering and conditioning of the recirculated atmosphere occurs in what is called the air house. In the production facility utilizing this system a nominal temperature of 70° F. and nominal relative humidity of 70% are maintained.

THE PRIOR ART

It is well known to provide paint systems that recirculate a relatively small proportion of the paint booth atmosphere in paint booths that have human operators working in the booths, and to draw off and replace with clean air a portion of the recirculated air. It is also well known to utilize the drawn off air as fuel to produce heat for paint related functions that require fuel for their operation. Such a system is disclosed is U.S. Pat. No(s) 4,266,504 and 4,351,863. The system disclosed in these patents is designed to provide comfort and safety to the human operators in the paint booths and is not designed to operate at the relatively high levels of volative organic compounds that are possible in a system utilizing robot paint dispensers. The system disclosed in these patents could not support autogenous combustion in the thermal oxidizer. The system disclosed in the above-identified patents produces an air pressure within the paint booth that is less than the ambient pressure outside the paint booth which causes the flow of contaminated air into the paint booth through any cracks or openings.

The thermal regenerator used in this system is a commercially available product that has been used in numerous commercial regeneration processes including paint bake ovens.

SUMMARY OF THE INVENTION

According to the invention, computer controlled robots are used in paint booths to apply paint to truck/-tractor cabs, parts, and accessories. The paint booth atmosphere is recirculated and a portion, for example 10 percent is directed to a thermal oxidizer. In a conventional paint line in which the spray booth atmosphere is not recirculated, the discharged atmosphere is directed to a thermal oxidizer which burns the atmosphere to thus reduce the VOC's. The VOC level of the discharged atmosphere from a conventional paint line is at a relatively low level and fuel must be supplied to the thermal oxidizer in order to burn the atmosphere. By recirculating the atmosphere the concentration of VOC's is enriched such that the atmosphere directed to the thermal oxidizer becomes self supporting (autogenous combustion) thus saving the cost of the fuel needed in a conventional system and also results in a smaller thermal oxidizer being used. The paint used in this invention includes a plurality of solvents proportioned so that the solvent concentration in the spray booth atmosphere of each solvent is at a level that will not inhibit evaporation of the solvent from the newly applied paint. The booth atmosphere is recirculated and is exposed to scrubbers at the bottom of the spray booth, which remove paint particulates moisture and mist. The paint, booth exhaust atmosphere is then sent to an air house where it is filtered several times, its humidity is reduced, and it is reheated to a predetermined optimum temperature and relative humidity and directed into the top of the spray booth. This atmosphere is again filtered as it flows downwardly through the top of the spray booth where a glamour paint finish environment has been created.

DESCRIPTION OF THE DRAWINGS

Other objects and advantages of the invention will become more apparent upon perusing the detailed description thereof and upon reference to the drawings in which.

DESCRIPTION OF THE PREFERRED EMBODIMENT

Figure 2:
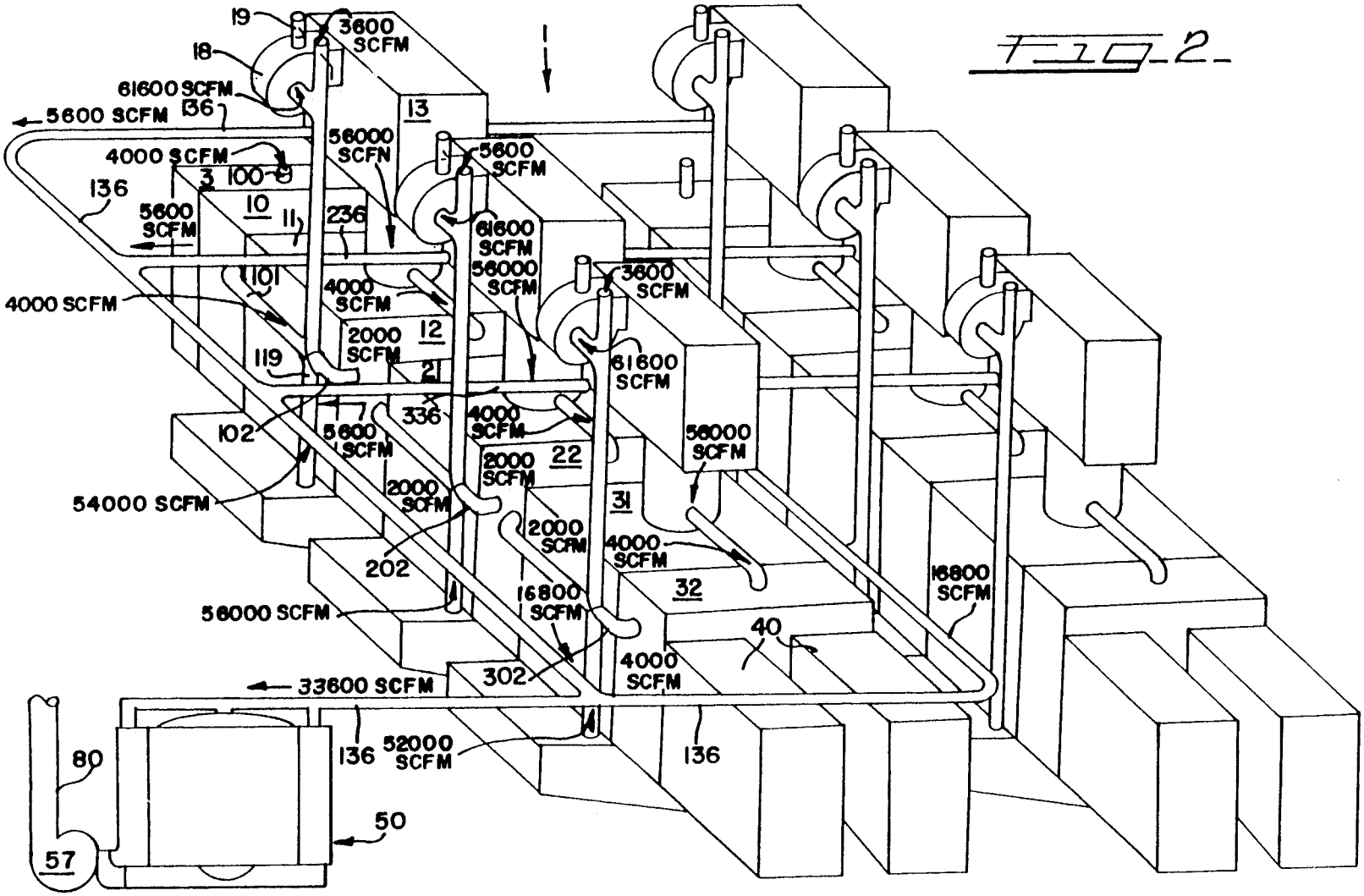
FIG. 2 is a sketch of the preferred embodiment of the paint system.

A diagram of the preferred embodiment is shown in FIG. 2. It should be understood that the articles to be painted by this system are prime painted prior to entering this system. The facility and method of prime painting these articles is not a part of the invention disclosed and claimed in this patent. The following description of how the articles to be painted in the system ar prime painted is for background purpose only. The truck cabs to be prime painted are mounted on skids that are lowered into primer tanks. The skids are then rocked to assure that all trapped air is removed. An electrical charge on the cabs attracts the primer to thus evenly coat all surfaces of the cabs. The cabs are then tacked off in a tack off booth 3 to remove any dust or contamination. Of course other methods of prime painting could be used.

In applicant's preferred facility there are two identical production lines for painting truck cabs and truck components. Both of these production lines are shown in FIG. 2. Since the lines are identical, reference numericals and flow rates are provided only for the left line as seen by the viewer. Only the left line will be described in detail since the right line is identical. The paint booth has a self-contained atmosphere, that is any air that enters or leaves the paint booth is carefully controlled by the system. The system is designed and constructed such that there is no unintentional ingress or egress of air or paint booth atmosphere to or from the contained atmosphere of the paint system. The paint system is serviced by robotic controlled spray systems and there are no humans present within the paint booth beyond the blow off and prime repair booth 10. The entire contained atmosphere paint booth is designated by reference numeral 1. As seen in FIG. 2, the truck cabs to be painted enter the blow off and prime repair booth 10 from the tack off booth 3 which is at the back of the drawing and are conveyed forwardly through the paint booth. In the booth 10 the primed truck cabs are blown off by humans having pressurized wands and any repair to the primer coat are made. Four thousand (4,000) standard cubic feet per minute of filtered air is supplied through conduit 100 into tack off booth 3 and is directed to flow toward booth 10. An equal amount of atmosphere, 4,000 standard cubic feet per minute, is removed from the booth 10 through conduit 101. This circulation creates VOC free atmosphere within the booths 3 and 10. The entrance to the tack off booth 3 and prime repair booth 10 is by necessity open to the air surrounding the paint booth 1. The atmosphere within the paint booth 1 is controlled such that there will be no flow of paint booth atmosphere out of the opening to the tack off booth 3 through which the truck cabs enter. The product to be painted enters the booth 3 fixed to a process fixture 60 that is connected to a conveyor 70. The process fixture 60 encounters a stop in the booths 3 and 10 and remains stationery for a fixed time period.

Figure 4:
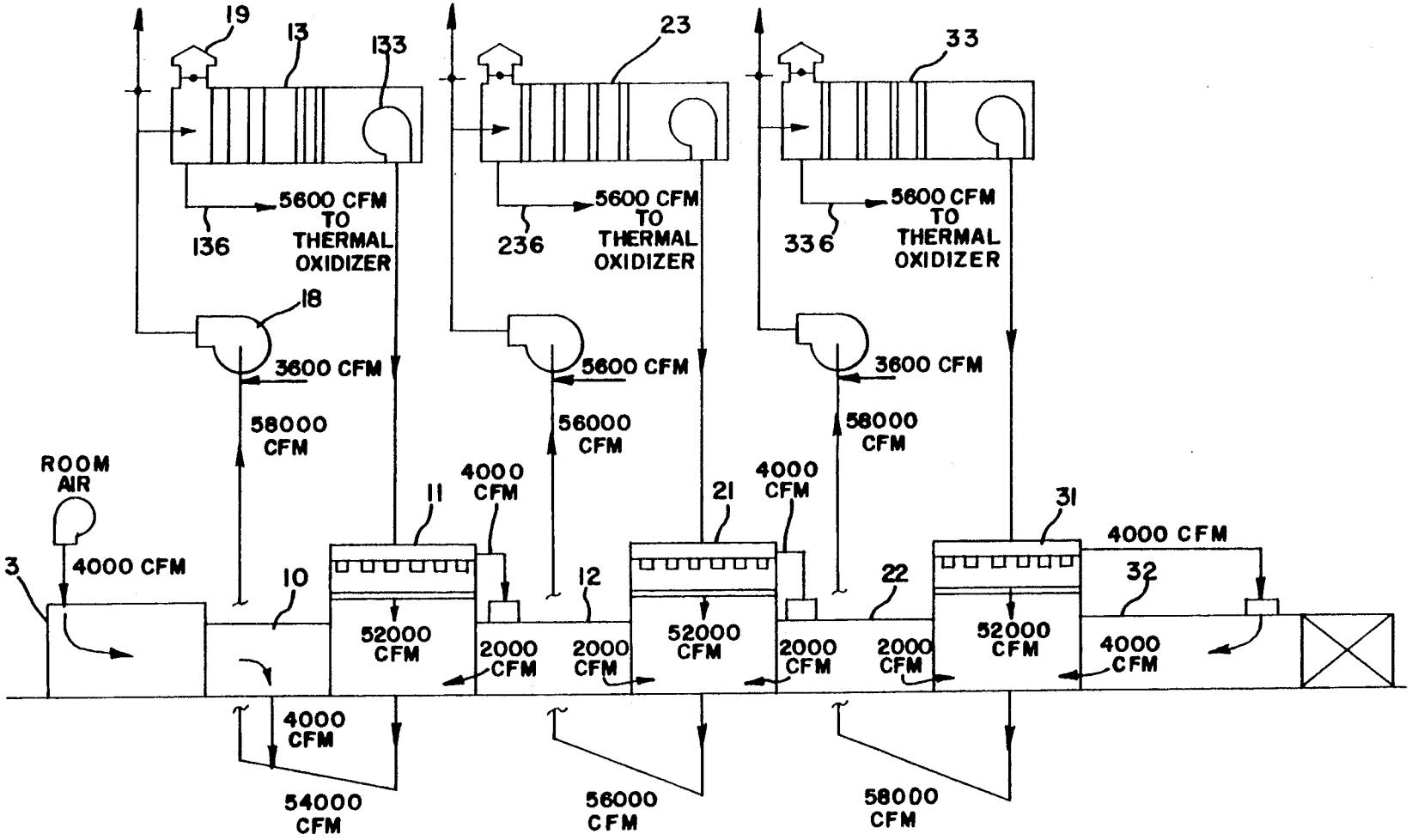
FIG. 4 is a schematic view of the paint booth system which is capable of providing multiple coats of paint in a production line.

After this cycle time has expired, the conveyor 70 moves the process fixture 60 upon which is mounted a product to be painted into the first spray booth 11. In the production facility that utilizes this invention there are four (4) robots for applying paint in each of the three spray booths along each of the paint lines. The process fixture upon which the product to be painted is stopped in the first spray booth 11 and the paint is applied by the robots while the product is stationery. In the production facility a thermal setting acrylic color coat is applied to the product in the first spray booth. After the cycle time for the product to be in the first spray booth 11 has expired, the conveyor 70 moves the process fixture 60 along with the product to be painted to the first flash-off tunnel 12. In the flash-off tunnel solvents from the newly applied paint are allowed to evaporate or flash-off. As shall be further discussed, the atmosphere surrounding the newly painted product affects the flash-off rate and the quality of the paint job. If the solvents do not flash off quickly enough, the newly applied paint could flow causing sags or thick areas. After the cycle time in the first flash-off tunnel 12 has expired, the conveyor 70 moves the process fixture 60 on which is mounted a product to be painted to the second spray booth 21. The product comes to a halt in the second spray booth for a cycle time. In the production facility utilizing this invention, in the second spray booth 21 a second thermal setting acrylic color coat is applied on top of the first color coat that was applied in the first spray booth 11. At this point in the painting cycle the first color coat is not yet completely dry and the second color coat is applied wet-on-wet. Upon expiration of the cycle time in the second spray booth 21, the conveyor moves the product to be painted to the second flash-off tunnel 22 where the solvents from the newly applied paint are allowed to flash off. After the cycle time in the second flash-off tunnel 22 has expired, the painted product is then conveyed into the third spray booth 31. In the production facility incorporating this invention a clear polyurethane coating is applied in the third spray booth over the color coatings that have been previously applied in the first and second spray booths. After the cycle time in the third spray booth 31 has expired, the painted product is then conveyed into the third flash-off tunnel 32 where the solvents from the just applied paint are allowed to flash off. In the production facility incorporating this invention, the third flash-off tunnel 32 is longer than the first and second flash-off tunnels 12 and 22. The relative lengths of the flash-off tunnels is illustrated in FIG. 4. Upon expiration of the cycle time in the third flash-off tunnel 32, the product that has now been painted is conveyed to the curing oven area 40. In the production facility incorporating this invention, dual curing ovens are provided. The painted products are alternately directed to one or the other ovens 40. This arrangement permits proper curing time in the curing ovens 40 and reduces the required oven length. The painted product exits the curing ovens 40 through open doors into an air drying area.

The atmosphere within the paint booth 1 is continuously recirculated and this recirculation system controls the volume of air ingressing and egressing the paint booth 1 such that the paint booth atmosphere is contained within the paint booth and does not flow out either the end where the product to be painted enters the spray booth or the end where the painted product leaves the spray booth. As best seen in FIG. 4 the air flow in the tack-off booth 3 and the third flash-off tunnel 32 is toward the center of the paint booth to thus prevent the escape of high VOC atmosphere from the spray booths 11, 21 and 31. The system for balancing this atmosphere flow is carefully controlled and will be described in detail.

Figure 1:
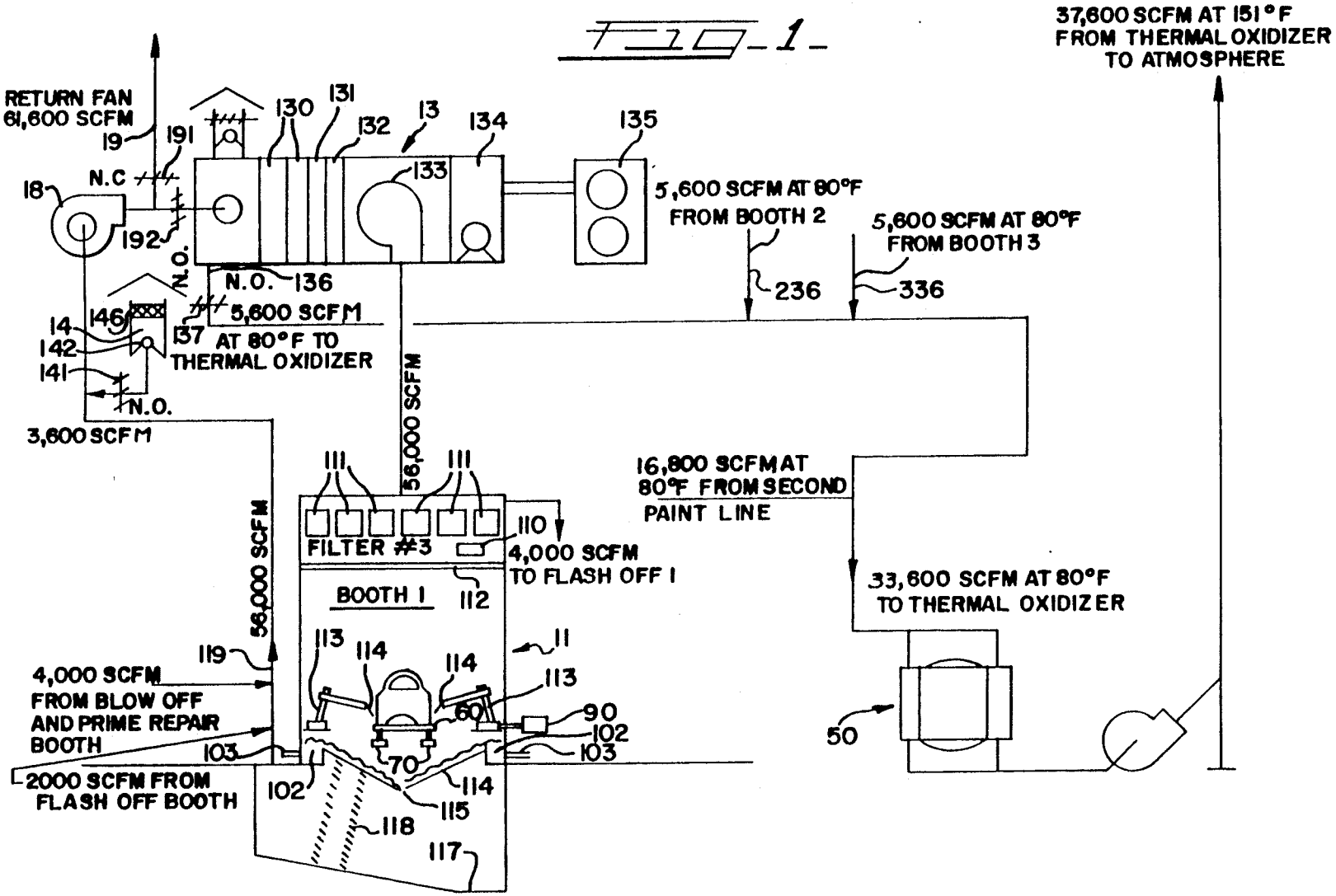
FIG. 1 is a schematic view of the first paint booth, its air house and the thermal generator.

Referring now to FIG. 1 of the drawings, a detailed description of the recirculation system for the first spray booth 11 will be described. This description will include a complete discussion of the means for controlling the solvent concentration in the paint booth atmosphere and the means for monitoring and controlling the volatile organic compounds present in the paint booth atmosphere. This detailed description will begin at the point where 56,000 standard cubic feet of processed paint booth atmosphere enters the top of first spray booth 11 creating a downdraft of air flowing through the spray booth. Mounted in the upper portion of first spray booth 11 are a number of pocket type filters 111. These filters are designed for use where fiberglass breakoff is undesirable and where low pressure drop results in optimum service life. The filters must be replaced periodically. A filter of this type is disclosed is U.S. Pat. No. 4,056,375 and reference may be had to this patent for a more complete disclosure of a pocket filter of the type used in the top of the paint booth. Below the pocket filters 111 is a ceiling filter 112 covering the entire ceiling area of spray booth 11. The ceiling filter 112 is designed for final filteration of the atmosphere flowing down into the paint area and are made from synthetic fibers that are bonded together. Sensor means 110 for monitoring the temperature, relative humidity and the volatile organic compounds in the atmosphere are located in the space between the pocket filters 111 and the ceiling filters 112. Sensor means 110 also function to transmit the data being monitored to the controls for the air conditioning and our control valves. In FIG. 1 two robots 113 are illustrated; however, it should be understood that as many robots as are required can be used. The robots 113 manipulate electrostatic robot spray guns 114. In the production facility incorporating this invention there are four robots in each spray booth. The robots are controlled by computers to move such that the particular surface of the object to be painted is completely and thoroughly covered. Paint is supplied to the robot 113 by means 90 that are external to the spray booth. The means 90 for supplying paint to the robots is controlled by computers such that the proper color paint is applied to the article to be painted. The product to be painted is mounted on a process fixture 60 that is conveyed through the paint booth 1 by a conveyor means 70. Below the conveyor 70 is a scrubber which is a system for removing paint particles that are carried in the air or atmosphere. Along each side of the first paint booth 11 are channels 102 that are filled by water through water inlet means 103. The water entering the channel 102 include detackification chemicals. The water from the channel 102 overflows onto flood sheets 114 which are inclined towards the center of the paint booth and terminate in edges forming a venturi 115 that extend the length of the spray booth. The water from the channel 102 flows down the flood sheets 114 and through the venturi 115 creating a low pressure zone in the venturi area. The paint booth atmosphere also flows through the venturi 115 and is exposed to the low pressure created by the venturi. This low pressure causes the paint particles to drop out of the atmosphere and fall into the water collecting sump 117. A mist eliminator 118 is located below the flood sheets 114 for the purpose of removing water from the paint booth atmosphere before it exits the spray booth. The mist eliminator causes the air to move through a labyrinth path allowing the moisture to collect on the surface of the mist eliminator. The moisture concentration of the atmosphere leaving the scrubber is near saturation (95 to 100% relative humidity). The water from the collecting sump 117, which has a very low solvent content (2 to 3% of the total solvents), is discharged for processing to remove the impurities. The paint booth atmosphere leaves the paint booth through a discharge duct 119. Of the 56,000 standard cubic feet per minute of air that enters the first paint booth 11, 4,000 goes immediately into the first flash off booth 12. The remaining 52,000 standard cubic feet per minute of air enters the first spray booth 11 and exits spray booth 11 through the discharge duct 119. 2,000 standard cubic feet per minute of air from the first flash off booth 12 and 4,000 standard cubic feet per minute of air from the blow off and prime repair booth 10 are added to the 52,000 standard cubic feet per minute of air being discharged from the first spray booth 11. There is also 3,600 standard cubic feet per minute of make up air added by the make-up air means 14. The make-up air means 14 includes a filter 140, a gas burner means 142 and a normally open valve 141. The total air discharged from the first spray booth 11, the first flash-off booth 12, the blow-off and prime repair booth 10 and the make-up air means 14 is conducted to the first return fan 18 which directs a total of 61,600 standard cubic feet per minute of air into the first air house 13. A first bypass stack 19 is located between the outlet of the fan and the inlet to the first air house 13 and includes a normally closed valve 191. This normally closed valve could be opened for example if the sensing means 110 indicated that the volatile organic compounds, as a result of some malfunction, had increased to a dangerous level. If this occurred the dangerous gases could be vented to atmosphere through the bypass stack 19. A normally open valve 192 would be closed by the same mechanism that opens the normally closed valve 191 to prevent the dangerous gases from entering the first air house 13. 5,600 standard cubic feet of air per minute are taken out of the first air house 13 through a conduit 136 and directed to the thermal oxidizer 50 which will be discussed in detail subsequently. Within the first air house 13 the air passes through a series of filters 130 which may be of the bag type disclosed in the previously identified U.S. Pat. No. 4,056,375, a cooling coil 131 and a reheating coil 132. Also contained in the first air house 13 is a refrigeration compressor 134 that is connected to the first air house condensing unit 135. A fan 133 within the first air house 13 directs 56,000 standard cubic feet per minute of filtered and conditioned air, at nominally 70° F. and a relative humidity of nominally 70% into the top of the first spray booth 11. A complete cycle of the air, beginning when it enters the first spray booth 11 flows through the paint booth and through the first air house 13 to the point where it is about to reenter the spray booth 11 for a second cycle, has been completed. The identical cycle is repeated in the second spray booth 21 and second air house 23 and again in the third spray booth 31 and third air house 33. The only difference between the cycle in the first, second and third spray booths are minor differences in the volume of air flowing at various points in the cycle. These air flow volumes are shown in FIG. 2.

In the earlier description of the operation of the first air house 13, it was mentioned that 5,600 standard cubic feet per minute of air flows from the first air house through conduit 136 to the thermal oxidizer 50. There is a normally open valve 137 in conduit 136 that could be closed in the event it was desired to stop flow to the thermal oxidizer. There is another 5,600 standard cubic feet per minute of air drawn off from the second air house 23 through a conduit 236 that is directed to the thermal oxidizer 50. From the third air house 33 there are 5,600 standard cubic feet per minute of air drawn off through conduit 336 that is directed to the thermal oxidizer 50. As previously stated, in the production facility that utilizes this invention there are two parallel paint booths, each of which includes three spray booths. A single thermal oxidizer 50 serves 10 both of these paint lines Thus from both paint lines a total of 33,600 standard cubic feet per minute of paint booth atmosphere is directed to the thermal oxidizer 50.

Figure 3:
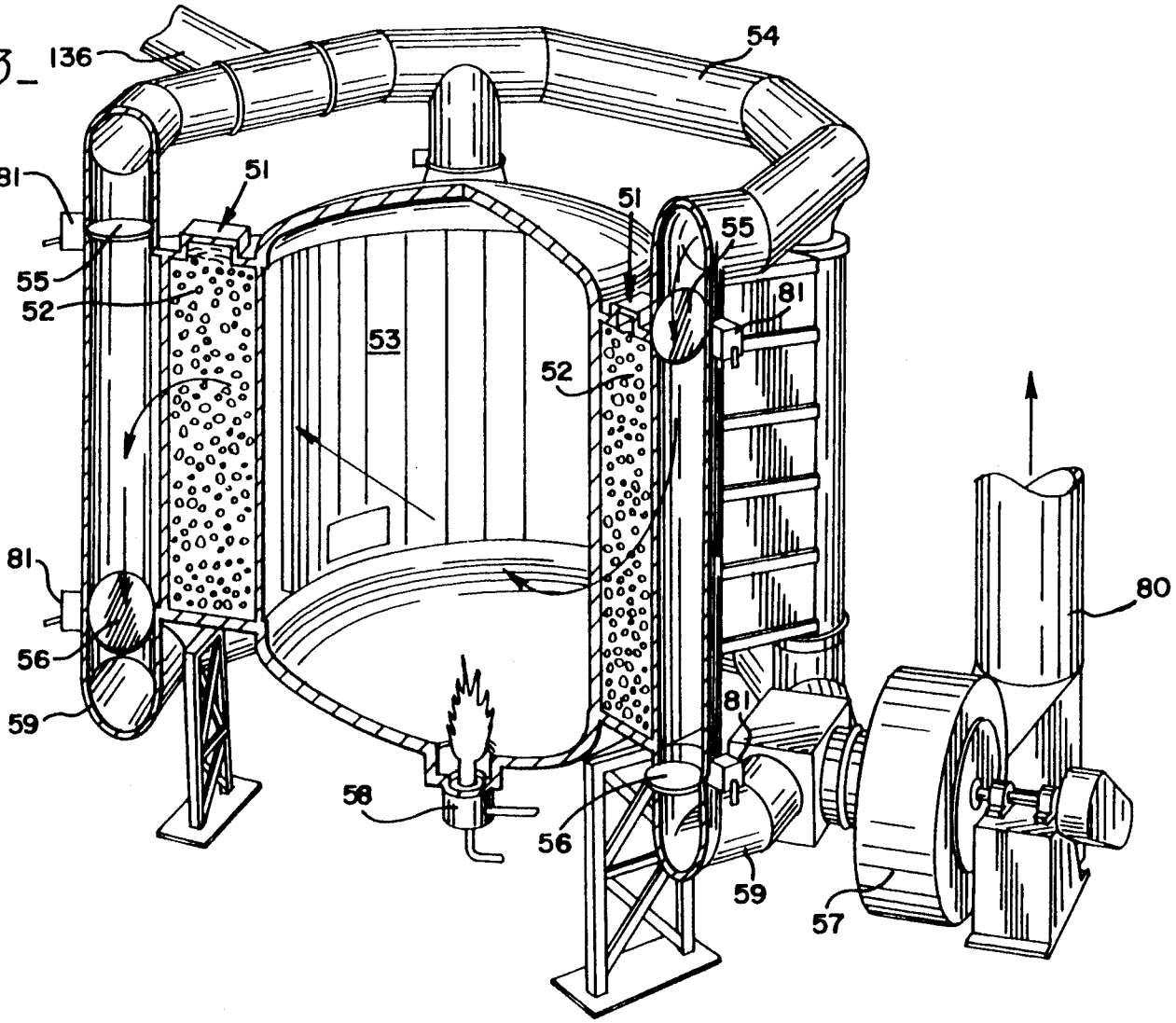
FIG. 3 is a broken away view of the thermal oxidizer.

Referring now to FIG. 3, the thermal oxidizer 50 will be discussed in detail. Conduit 136 connects to an upper ring shaped manifold 54 conveying the 33,600 standard cubic feet per minute of solvent laden air into the upper ring shaped manifold 54. The thermal oxidizer 50 includes a central combustion incineration chamber 53 which is surrounded by a plurality of energy recovery chambers or lobes 51 that function as heat exchangers The lobes 51 are filled with ceramic stoneware 52 that function as the heat exchange media. Each of the lobes 51 has a pair of controlled valves 55 and 56 that can be positioned to permit the flow from the upper ring shaped manifold 54 into an outer chamber of the lobe 51. Valves 55 and 56 are opened and closed sequentially by hydraulic control means 81. With upper valve 55 open and lower valve 56 closed the lobe is in the inlet mode. From the outer chamber of the lobe 51 the solvent laden air passes through the ceramic stoneware 52 into the central combustion chamber 53. The temperature of the solvent laden air entering the lobe 51 is approximately 80° F. When the thermal generator 50 has reached operating temperatures, the air leaves the lobe 51 at an elevated temperature approximately the same as the temperature within the combustion chamber 53. As the solvent laden air passes through the ceramic stoneware 52 its temperature is increased to the point where when it enters the combustion chamber it will self-ignite and burn [autogenous] and thus the need for fuel to burn the solvent laden air is eliminated. There is at least one gas burner 58 in the bottom of the central combustion chamber 53 for start up purposes and for the situation when autogenous combustion does not occur. The gases that remain after combustion of the solvent laden air are pulled through another lobe 51 which has its valves 55 and 56 in the outlet mode. In the outlet mode valve 55 is closed and valve 56 is open. The bottom of the lobes 51 are connected to a lower ring shaped manifold 59 and when outlet flow valve 56 is open the combustion gases having passed through and having heated up by the ceramic stoneware 52 flow from the outer chamber of the lobe into the lower ring shaped manifold 59 and are exhausted to the atmosphere through a stack 80. An exhaust fan 57 functions to pull the combustion gases through the ceramic stoneware 52 and forces them up through the stack 80. The gas burner 58 maintains a preset incineration temperature within the incineration chamber 53. If the incoming solvent laden air contains sufficient amounts of solvent the heat generated by burning these gases provides the necessary energy to operate this equipment and the gas burner 50 goes automatically to pilot.

The thermal oxidizer 50 is designed such that it has an odd number of lobes 51. One lobe is at any given time in idle mode, that is, in transmission from inlet to outlet mode or vice versa. Half of the other chambers are in inlet mode, that is, the upper valves 55 are open and the lower valves 56 are closed while the other half of the lobes are in outlet mode. Thus the thermal oxidizer 50 is regenerative and operates with little or no fuel. The temperature of the gases that enter the stack 80 are at a temperature slightly higher than the temperature of the solvent laden air that entered the thermal oxidizer. As a result of the incineration that occurred within the thermal oxidizer, these gases exiting through stack 80 are relatively pollution-free. The retention time of the gases in the incineration chamber is approximately one (1) second. One by one the lobes 51 change from inlet mode to outlet mode via the idle mode and back to inlet mode. In this fashion energy is absorbed from the clean gases flowing from the combustion chamber 53, stored in the ceramic stoneware 52 and this stored energy is then used to preheat the next cycle of incoming solvent laden gases.

referring again to FIG. 2 for a further discussion of the volumetric flow of the gases through the paint booth system. There is shown a conduit 102 connecting the first flash off tunnel 12 to the conduit 119 carrying the exhaust air upwardly towards the first return fan 18. Conduit 102 is shown in FIG. 2 for illustrative purposes only. Actually, as shown in FIG. 4, the 2,000 standard cubic feet per minute of air indicated to be flowing through conduit 102 flows directly from the flash off tunnel into the first spray booth 11 through the connecting opening between the first spray booth 11 and the first flash off tunnel 12. The same is true for conduit 202 that connects the second flash off tunnel 22 to the vertical conduit and conduit 203 that connects the third flash off tunnel 32 to the vertical conduit.

We claim:

1. A method of applying paint to an article in a contained atmosphere paint booth which comprises the steps of:

(a) recirculating the paint booth atmosphere to enrich the volatile organic compounds contained therein;
(b) filtering the paint booth atmosphere to eliminate impurities;
(c) air-conditioning the paint booth atmosphere to maintain a constant temperature and humidity in the paint booth;
(d) applying paint to articles in the paint booth with a paint dispenser that is under the control of a robot;
(e) supplying paint that includes multiple solvents to the paint dispenser;
(f) controlling the solvent concentration in the paint booth atmosphere such that the evaporation rate of the newly applied paint prevents sag; and
(g) maintaining an upper limit of fifteen percent saturation for any one solvent in the paint booth atmosphere.

2. A method of applying paint to an article as set forth in claim 1 including the additional step of:

(h) scrubbing the paint booth atmosphere to remove paint particles that are suspended therein.

3. A method of applying paint to an article as set forth in claim 1 wherein the step of selecting a paint that includes multiple solvents further includes the step of selecting a paint that has solvents that are low vapor pressure solvents.

4. A method of applying paint to an article as set forth in claim 3, including the additional step of:

(h) scrubbing the paint booth atmosphere to remove paint particles that are suspended therein.

5. A method of applying paint to an article as set forth in claim 1 wherein the step of selecting a paint that includes multiple solvents further includes the step of selecting a paint that includes at least three solvents, none of which comprise more than 50% of the total solvents.

6. A method of applying paint to an article as set forth in claim 5 wherein the step of selecting a paint that includes multiple solvents further includes the step of selecting a paint that has solvents that are low vapor pressure solvents.

7. A method of applying paint to an article as set forth in claim 5 including the additional step of:

(h) scrubbing the paint booth atmosphere to remove paint particles that are suspended therein.

8. A method of applying paint to an article in a contained atmosphere paint booth which comprises the steps of:

(a) containing the atmosphere of a paint booth;
(b) providing robot controlled electrostatic paint dispensing means within said paint booth;
(c) selecting a paint that includes multiple solvents;
(d) feeding the selected paint to the paint dispensing means within the paint booth from external of the paint booth;
(e) controlling the solvent concentration in the paint booth atmosphere by maintaining an upper limit of fifteen percent saturation for any one solvent such that urethane clearcoat and thermal setting acrylic paints can be applied and the flash-off rate of the newly applied paint is adequate to prevent sagging of the paint;
(f) monitoring and controlling the volatile organic compounds present in the paint booth atmosphere such that the level of volatile organic compounds does not exceed 25% of its lower explosive level; and
(g) applying paint to articles in the paint booth with the robot controlled electrostatic paint dispensing means.

9. A method of applying paint to an article as set forth in claim 8 wherein the step of selecting a paint that includes multiple solvents further includes the step of selecting a paint that includes at least three solvents, none of which comprise more than 50% of the total solvents.

10. A method of applying paint to an article as set forth in claim 8 wherein said the step of selecting a paint that included multiple solvents further includes the step of selecting a paint that has solvents that are low vapor pressure solvents.

11. A method of applying paint to an article in a contained atmosphere paint booth as set forth in claim 8 wherein the step of monitoring and controlling the volatile organic compounds includes the steps of:

(h) providing a thermal oxidizer externally of the paint booth;
(i) connecting the paint booth and the thermal oxidizer;
(j) feeding a controlled amount of paint booth atmosphere to the thermal oxidizer; and
(k) oxidizing the paint booth atmosphere that has been fed to the thermal oxidizer.

12. A method of applying paint to an article as set forth in claim 11 wherein the step of selecting a paint that includes multiple solvents further includes the step of selecting a paint that includes at least three solvents, none of which comprise more than 50% of the total solvents.

13. A method of applying paint to an article in a contained atmosphere paint booth as set forth in claim 11, wherein the following additional steps are performed:

(l) recirculating the paint booth atmosphere; and (m) adding fresh air to the paint booth atmosphere being recirculated in an amount equal to the amount of paint booth atmosphere that was fed to the thermal oxidizer.

14. A method of applying paint to an article in a contained atmosphere paint booth as set forth in claim 13 including the additional step of:

(n) scrubbing the paint booth atmosphere to remove paint particles that are suspended therein.

15. A method of applying paint to an article in a contained atmosphere paint booth as set forth in claim 13 including the additional steps of:

(n) filtering the added fresh air to remove impurities; and (o) air-conditioning the added fresh air to control its temperature and humidity.

16. A method of applying paint to an article in a contained atmosphere paint booth as set forth in claim 11 including the additional step of:

(l) scrubbing the paint booth atmosphere to remove paint particles that are suspended therein.

17. A method of applying paint to an article in a contained atmosphere paint booth as set forth in claim 16 including the additional steps of:

(m) filtering the added fresh air to remove impurities; and (n) air-conditioning the added fresh air to control its temperature and humidity.

18. A method of applying paint to an article in a contained atmosphere paint booth as set forth in claim 11 wherein the step of feeding a controlled amount of paint booth atmosphere to the thermal oxidizer further includes the steps of:

(l) feeding the paint booth atmosphere to a heat exchange chamber of the thermal oxidizer where its temperature is increased;

(m) feeding the increased temperature paint booth atmosphere to a combustion chamber of the thermal oxidizer where the step of oxidizing the paint booth atmosphere takes place; and (n) utilizing the heat generated from the oxidation of the paint booth atmosphere in the combustion chamber to increase the temperature in the heat exchange chamber.

19. A method of applying paint to an article in a contained atmosphere paint booth which comprise the steps of:

(a) containing the atmosphere of a paint booth;

(b) providing robot controlled electrostatic paint dispensing means within said paint booth;

(c) feeding paint to the paint dispensing means within the paint booth from external of the paint booth;

(d) controlling the solvent concentration in the paint booth atmosphere such that urethane clearcoat and thermal setting acrylic paints can be applied and the flash-off rate of the newly applied paint is adequate to prevent sagging of the paint;

(e) monitoring and controlling the percent saturation for any one solvent present in the paint booth atmosphere such that the percent saturation for any one solvent does not exceed 15% to thus insure safe operation of the paint booth facility; and (f) applying paint to articles in the paint booth with the robot controlled electrostatic paint dispensing means.

20. A method of applying paint to an article as set forth in claim 19 wherein the step of feeding paint to the paint dispenser further includes the step of selecting a paint that includes multiple solvents.

21. A method of applying paint to an article as set forth in claim 20 wherein the step of selecting a paint that included multiple solvents further includes the step of selecting a paint that has solvents that are low vapor pressure solvents.

22. A method of applying paint to an article as set forth in claim 21 including the additional step of:

(g) scrubbing the paint booth atmosphere to remove paint particles that are suspended therein.

23. A method of applying paint to an article as set forth in claim 20 wherein the step of selecting a paint that includes multiple solvents further includes the step of selecting a paint that includes at least three solvents, none of which comprise more than 50% of the total solvents.

24. A method of applying paint to an article in a contained atmosphere paint booth as set forth in claim 19 wherein the step of monitoring and controlling the percent saturation for any one solvent in the paint booth atmosphere includes the additional steps of:

(g) providing a thermal oxidizer externally of the paint booth;

(h) connecting the paint booth and the thermal oxidizer;

(i) feeding a controlled amount of paint booth atmosphere to the thermal oxidizer; and (j) oxidizing the paint booth atmosphere that has been fed to the thermal oxidizer.

25. A method of applying paint to an article in a contained atmosphere paint booth as set forth in claim 24 including the additional steps of:

(k) recirculating the paint booth atmosphere;

(l) adding fresh air to the paint booth atmosphere being recirculated in an amount equal to the amount of paint booth atmosphere that was fed to the thermal oxidizer;

(m) filtering the added fresh air to remove impurities; and (n) air-conditioning the added fresh air to control its temperature and humidity.

26. A method of applying paint to an article as set forth in claim 24 wherein the step of feeding paint to the paint dispenser further includes the step of selecting a paint that includes multiple solvents.

27. A method of applying paint to an article as set forth in claim 26 wherein the step of selecting a paint that includes multiple solvents further includes the step of selecting a paint that includes at least three solvents, none of which comprise more than 50% of the total solvents.

28. A method of applying paint to an article in a contained atmosphere paint booth as set forth in claim 26, wherein the following additional steps are performed:

(k) recirculating the paint booth atmosphere; and (l) adding fresh air to the paint booth atmosphere being recirculated in an amount equal to the amount of paint booth atmosphere that was fed to the thermal oxidizer.

29. A method of applying paint to an article as set forth in claim 28 including the additional step of:

(m) scrubbing the paint booth atmosphere to remove paint particles that are suspended therein.

30. A method of applying paint to an article in a contained atmosphere paint booth as set forth in claim 29 including the additional steps of:

(n) filtering the added fresh air to remove impurities; and (o) air conditioning the added fresh air to control its temperature and humidity.

31. A method of applying paint to an article in a contained atmosphere paint booth as set forth in claim 28 including the additional steps of:

(m) filtering the added fresh air to remove impurities; and (n) air-conditioning the added fresh air to control its temperature and humidity.

32. A method of applying paint to an article in a contained atmosphere paint booth as set forth in claim 24 wherein the following steps are followed in feeding a controlled amount of paint booth atmosphere to the thermal oxidizer:

(k) feeding the paint booth atmosphere to a heat exchange chamber in the thermal oxidizer where its temperature in increased;

(l) feeding the increased temperature paint booth atmosphere to a combustion chamber in the thermal oxidizer where the step of oxidizing the paint booth atmosphere takes place; and (m) utilizing the heat generated from the oxidization of the paint booth atmosphere in the combustion chamber to increase the temperature in the heat exchange chamber.

33. A method of applying paint to an article as set forth in claim 32 wherein the step of feeding paint to the paint dispenser further includes the step of selecting a paint that includes multiple solvents.

34. A method of applying paint to an article as set forth in claim 33 wherein the step of selecting a paint that includes multiple solvents further includes the step of selecting a paint that includes at least three solvents, none of which comprise more than 50% of the total solvents.

* * * * *